US011193221B2

(12) United States Patent
Hymas et al.

(10) Patent No.: US 11,193,221 B2
(45) Date of Patent: Dec. 7, 2021

(54) KNITTED COMPONENT

(71) Applicant: adidas AG, Herzogenaurach (DE)

(72) Inventors: Jessica Dorothy Janine Hymas, Nuremberg (DE); Michael Braun, Wernberg-Köblitz (DE); Yu Ju Peng, Nuremberg (DE)

(73) Assignee: adidas AG, Herzogenaurach (DE)

( * ) Notice: Subject to any disclaimer, the term of this patent is extended or adjusted under 35 U.S.C. 154(b) by 44 days.

(21) Appl. No.: 16/230,723

(22) Filed: Dec. 21, 2018

(65) Prior Publication Data

US 2019/0191821 A1 Jun. 27, 2019

(30) Foreign Application Priority Data

Dec. 22, 2017 (DE) ..... 10 2017 223 750.3

(51) Int. Cl.
*D04B 1/10* (2006.01)
*D04B 1/24* (2006.01)

(52) U.S. Cl.
CPC ..... *D04B 1/102* (2013.01); *D04B 1/104* (2013.01); *D04B 1/24* (2013.01); *D10B 2501/043* (2013.01)

(58) Field of Classification Search
CPC ..... D04B 1/02; D04B 1/102; D04B 1/104; D04B 1/26; D04B 1/265; A43B 1/04
USPC ..... 66/177, 196
See application file for complete search history.

(56) References Cited

U.S. PATENT DOCUMENTS 3,971,234 A * 7/1976 Taylor ..... D04B 1/18 66/200
4,010,626 A * 3/1977 Feher ..... D04B 1/104 66/93
4,103,518 A * 8/1978 Lombardi ..... D04B 1/02 66/107
4,194,249 A * 3/1980 Thorneburg ..... D04B 1/02 2/239

(Continued)

FOREIGN PATENT DOCUMENTS

CH 465117 11/1968
CN 1585869 A 2/2005

(Continued)

OTHER PUBLICATIONS

Partial Translation from USPTO of JP 2003003355 Nippon (Year: 2003).*

(Continued)

*Primary Examiner* — Khoa D Huynh
*Assistant Examiner* — Grace Huang
(74) *Attorney, Agent, or Firm* — Sterne, Kessler, Goldstein and Fox P.L.L.C.

(57) ABSTRACT

The present invention concerns a knitted component, especially for an article of apparel or footwear, including: a first knitted layer, including a knitted first portion with a first linear loop density along a first direction, a knitted second portion with a second linear loop density along the first direction, wherein the second linear loop density is greater than the first linear loop density; a second knitted layer, including a knitted third portion with a third linear loop density along a second direction, a knitted fourth portion with a fourth linear loop density along the second direction; wherein the first knitted layer is connected to the second knitted layer.

18 Claims, 7 Drawing Sheets

(56) References Cited

U.S. PATENT DOCUMENTS

Figure 1A:
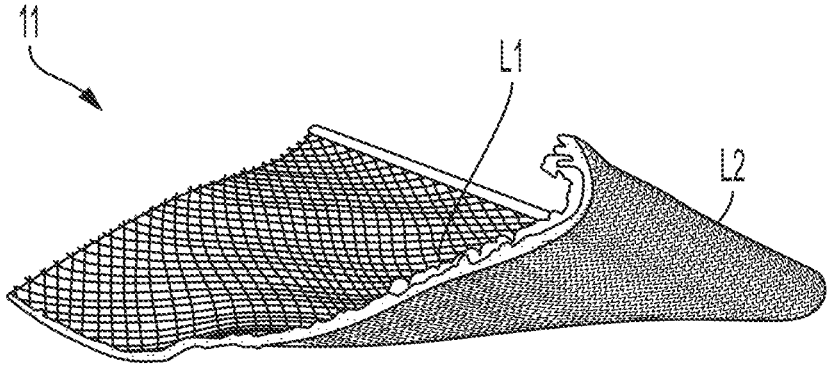

| | | | | | |
|---|---|---|---|---|---|
| 4,236,257 | A * | 12/1980 | Williams | A41B 9/004 | 2/406 |
| 4,267,710 | A * | 5/1981 | Imamichi | D04B 1/12 | 66/196 |
| 4,341,096 | A * | 7/1982 | Safrit | A41B 11/005 | 66/185 |
| 4,520,635 | A * | 6/1985 | Shields | A41B 11/02 | 2/239 |
| 4,554,802 | A | 11/1985 | Goller et al. | | |
| 4,748,078 | A * | 5/1988 | Doi | D04B 21/12 | 442/312 |
| 4,893,482 | A * | 1/1990 | Frenzel | D04B 21/165 | 66/190 |
| 5,540,063 | A * | 7/1996 | Ferrell | D04B 1/106 | 66/172 E |
| 6,158,254 | A | 12/2000 | Richard | | |
| 7,192,411 | B2 * | 3/2007 | Gobet | A61F 13/08 | 2/239 |
| 7,611,999 | B2 * | 11/2009 | McMurray | D04B 1/102 | 442/304 |
| 7,636,950 | B2 | 12/2009 | Melhart et al. | | |
| 7,950,071 | B2 * | 5/2011 | Jeong | D04B 1/102 | 2/239 |
| 8,468,856 | B2 * | 6/2013 | Fukui | D04B 1/126 | 66/178 R |
| 10,368,606 | B2 * | 8/2019 | Meir | A43B 1/04 | |
| 10,494,747 | B2 * | 12/2019 | Atmanspacher | D04B 1/26 | |
| 2004/0137822 | A1 | 7/2004 | Mitchell | | |
| 2011/0192198 | A1 | 8/2011 | Green et al. | | |
| 2013/0053744 | A1 | 2/2013 | Convert et al. | | |
| 2014/0310983 | A1 * | 10/2014 | Tamm | A43B 23/024 | 36/83 |
| 2016/0029736 | A1 * | 2/2016 | Meir | D04B 1/22 | 36/9 R |
| 2017/0027719 | A1 | 2/2017 | Bache et al. | | |
| 2017/0311672 | A1 * | 11/2017 | Hipp | A43B 23/026 | |
| 2018/0199668 | A1 * | 7/2018 | Yumiba | D04B 7/30 | |

FOREIGN PATENT DOCUMENTS

| | | | | | |
|---|---|---|---|---|---|
| CN | 103255559 | A | | 8/2013 | |
| CN | 104106882 | A | | 10/2014 | |
| CN | 203923572 | U | | 11/2014 | |
| CN | 204690248 | U | | 10/2015 | |
| CN | 107455840 | A | | 12/2017 | |
| DE | 19855541 | A1 | | 6/2000 | |
| EP | 2 628 832 | A1 | | 8/2013 | |
| GB | 482438 | A | * | 3/1938 | D04B 1/102 |
| GB | 744260 | A | * | 2/1956 | D04B 1/18 |
| JP | S 57-47968 | A | | 3/1982 | |
| JP | 61239064 | A | * | 10/1986 | D04B 21/06 |
| JP | S 61-239064 | A | | 10/1986 | |
| JP | 2003-003355 | A | | 1/2003 | |
| JP | 2003003355 | A | * | 1/2003 | D04B 21/06 |
| WO | WO-2016144971 | A1 | * | 9/2016 | B29C 70/48 |
| WO | WO 2017/077021 | A1 | | 5/2017 | |

OTHER PUBLICATIONS

Extended European Search Report issued in European Patent Application No. 18215000.3, dated Mar. 22, 2019, 10 pages.

* cited by examiner

KNITTED COMPONENT

TECHNICAL FIELD

The present invention relates to a knitted component with engineered stiffness and elasticity, especially for use in apparel or footwear, and methods for producing the same.

PRIOR ART

Knitted components are popular in many types of apparel or footwear. Knitted fabric tends to be lightweight and stretchable and therefore lends itself to many uses. Apparel or footwear made from knitted components is comfortable and lightweight. Knitting enables a number of ways of engineering the properties of the knitted fabric. The two basic types of knitting: weft knitting and warp knitting enable different structural motives to be realized. Different knitting patterns can be knitted with different structural stability, stretchability or elasticity, and weight per unit area.

Different portions of a fabric are subject to different requirements. For example, in a shoe upper certain regions, such as a toe region, a heel region, or a metatarsal region, require more support than other regions, such as the instep region. As a further example, functional sports clothing is popular in many sports such as athletics, football, hiking, skiing, etc. Functional sports clothing provides stiffness and support where required, e.g. to protect a joint, but the right level of flexibility where necessary, for example around a knee or an elbow. However, it is a disadvantage of existing knitting techniques, that engineering certain properties, such as stretchability or elasticity, to vary across different portions of a knitted component is a complex and time consuming task. Such different properties may be achieved by complex knitting patterns. However, it can take hours for a single knitted component with complex knitting patterns to be knitted, even on modern knitting machines, which increases the cost of the resulting articles of footwear or apparel.

Properties that vary across the knitted component can also be engineered by using different types of yarn. However, the number of yarn carriers limits the number of different types of yarn that can be used. The complexity and thus the time required for the knitting process is also increased by using several types of yarn.

It is known in the prior art, that the properties of a knitted component can be modified after the knitting operation is completed by coating the knitted component with a material with the desired mechanical properties. U.S. Pat. No. 7,636,950 B2 discloses an article of apparel comprising a torso region and a pair of arm regions, at least one of the arm regions having an elbow portion for extending around an elbow joint of a wearer, the elbow portion including: a pair of first areas oriented substantially parallel to a plane of bending of the elbow joint and located on opposite sides of the elbow portion, the first areas having a first degree of stretch resistance in a direction extending around the elbow portion; and a pair of second areas oriented substantially perpendicular to the plane of bending of the elbow joint and located on opposite sides of the elbow portion, the second areas having a second degree of stretch resistance in the direction extending around the elbow portion, the first degree of stretch resistance being less than the second degree of stretch resistance. A polymer material is secured to the elbow portion, the polymer material defining a plurality of apertures in the pair of first areas, a size of the apertures increases as a position of the apertures approaches the second areas, and the polymer material being a plurality of discrete elements in the second areas, and a size of the elements increases as a position of the elements approaches the first areas. However, there are several disadvantages of this way of engineering the properties of a knitted fabric. Firstly, the coating operation is a separate process step that requires additional time and resources, e.g. for applying and for then curing the polymer. Secondly, the breathability of such a knitted component is poor, because of the polymer coating. Moreover, the coating is detrimental to the feel of the surface of the knitted component and thus the wearing comfort.

It is hence an object of the present invention to provide a lightweight, comfortable knitted component whose properties can be engineered to vary across different portions of the knitted component, which overcomes the mentioned limitations of the existing techniques.

It is known that the stitch length, or stitch height, can be modified during knitting. CH 465,117 discloses a method for the manufacture of a knitted fabric on a flat knitting machine with a cam system characterized in that the stitch length and thus the strength of the knit of the knitted fabric is adjusted over the width of the knitted sheet during the knitting process by the adjustment of the sinker needle (6) during the carriage stroke of the cam carrier. U.S. Pat. No. 4,554,802 discloses a carriage that is reciprocable along a needle bed of a flat knitting machine and carries a needle cam. A pair of stitch cams are adjustably supported by the carriage and are disposed so as to trail behind the needle cam in alternate strokes of the carriage, respectively. An adjustment mechanism includes a stepping motor which adjusts the trailing stitch cam not only at the beginning of the respective stroke but also during the course of the stroke itself, thereby enabling the stitch density to be varied within each row of the knitted article as well as from row to row.

However, these methods to modify stitch lengths during knitting have not been applied for the production of apparel or in footwear. A key problem is that a differential in the knitting stitch length, or stitch height, is not stable and thus the differential is not maintained in a knitted fabric. Instead, during further processing of the knitted fabric or when such an article of apparel or footwear is worn, the differential in stitch length is lost. Thus, it is not possible with present methods, to produce a knitted component with locally varying properties by varying the stitch length.

It is a further problem of the present invention, to overcome the existing problems in maintaining a differential in stitch length across a knitted fabric in order to locally engineer the mechanical properties, in particular the stiffness, elasticity, and strength of a knitted fabric.

SUMMARY OF THE INVENTION

The problems underlying the present invention are solved by a knitted component, especially for an article of apparel or footwear, comprising: (a) a first knitted layer, comprising a knitted first portion with a first linear loop density along a first direction, a knitted second portion with a second linear loop density along the first direction, wherein the second linear loop density is greater than the first linear loop density; (b) a second knitted layer, comprising a knitted third portion with a third linear loop density along a second direction, a knitted fourth portion with a fourth linear loop density along the second direction; wherein the first knitted layer is connected to the second knitted layer.

A knitted component according to the present invention may be used for any article of apparel or footwear. A knitted component according to the present invention may also find applications for example in medical bandages to prevent or treat injuries.

It is to be understood that a knitted component according to the present invention may comprise any number of layers greater than or equal to two, for example a knitted component according to the present invention may comprise two layers, as another example a knitted component according to the present invention may comprise three layers.

The linear loop density is the density of loops measured along a first direction, which may be a wale direction. The smallest length scale on which a meaningful loop density can be measured is given by two loops interlocked by knitting. In this case, the linear loop density is the inverse of the distance between corresponding elements of the two loops, for example the inverse of the distance between the apex of the first loop and the apex of the second loop, wherein the apex is located at the top of a loop.

It is to be understood that the description of the knitted component herein pertains to a knitted component in an equilibrium state without any external force in any direction being applied (apart from gravity). It is also to be understood that the first portion and the second portion with their different linear loop densities are formed systematically in the knitted component and not by accident, for example by a knitting error. Preferably, the first portion and the second portion occupy at least 5% each of the total area of the first layer of the knitted component. More preferably, the first portion and the second portion occupy at least 20% each of the total area of the first layer of the knitted component. For example, the first portion may occupy 20% of the total area of the first layer while the second portion may occupy 80% of the total area of the first layer.

The differential in linear loop density is also not due to random fluctuations due to, for example, manufacturing imperfections. Preferably, the first portion and the second portion each comprise at least three adjacent knitted loops. More preferably, the first portion and the second portion each comprise at least five adjacent knitted loops. It is important to note, that the variation in loop density may be gradual between the first portion and the second portion. In this case, half of the area over which the loop density varies gradually should be considered as being part of the first portion and the other half of that area should be considered as being part of the second portion for the purpose of calculating the area of the first portion and of the second portion. Correspondingly, half of the number of loops in the region of gradual variation should be considered as being part of the first portion and the other half of those loops should be considered as being part of the second portion for the purpose of calculating the number of loops of the first portion and of the second portion.

For the first knitted layer, since the second linear loop density in the second portion is greater than the first linear loop density in the first portion, the second portion generally has a greater stiffness and thus greater strength than the first portion. Thus, the properties of the knitted component can be engineered to provide the right amount of strength and stiffness in certain regions and sufficient flexibility and elasticity in other regions.

An advantage of the present invention is that a knitted component according to the present invention does not require different types of yarn to locally engineer the mechanical properties of the knitted component.

Another advantage of the knitted component according to the present invention is that the knitted component according to the present invention does not require more than one knitting pattern in order for the properties of the knitted component to be engineered to differ across the knitted component.

A knitted component according to the present invention does not require any type of coating, such as a polymer coating, in order for its properties to be engineered locally. Therefore, an additional process step of applying a coating is not required, thus simplifying the production of apparel or footwear comprising a knitted component. In addition, the breathability and thus the wearing comfort of a knitted component according to the present invention is improved over a coated knitted component, for which the coating deteriorates the breathability of the material.

A knitted component according to the present invention may be manufactured using warp knitting or weft knitting. The loop density can be controlled by controlling the stitch height or stitch length during the knitting process. The stitch length is the length of yarn which includes one needle loop and half the length of yarn, i.e. half a sinker loop, between that needle loop and the adjacent needle loops on either side of it. The stitch height is the corresponding height of the knitted loop along the wale. Therefore, in the present invention, varying the stitch height has the same effect as varying the stitch length and both expressions are used to describe the present invention. In practice, the stitch height is controlled by what the skilled person usually refers to as needle sinker position (NSP), i.e. the position of the cam system during knitting.

However, the length of a loop on a finished article of apparel or footwear does not have to be identical to the stitch length during knitting. The reason for that is that the knitted loop may shrink or expand during further processing or while an article of apparel or footwear, which comprises a knitted component according to the invention, is being worn. For example, a knitted loop may shrink or expand during bleaching or washing of the knitted component. A knitted loop may also shrink or expand when an upper comprising a knitted component according to the invention is lasted on a last and processed, for example by applying heat.

The primary purpose of the second layer is to stabilize the differential in loop density i.e. the stitch height or stitch length. By differential it is meant in the present context, any variation between the first portion and the second portion, and/or a third portion and a fourth portion. Without a second layer, the differential in loop density could not be maintained during processing of the knitted component or during normal use for example during washing or wearing of an article of apparel or footwear comprising the knitted component. For example, the differential may be lost during bleaching of the knitted component or when an upper comprising the knitted component is lasted on a last. The inventors have found that by connecting first knitted layer to the second knitted layer and in particular by knitting them together in a unitary construction, the differential in loop density can be permanently and securely maintained even during bleaching, washing, lasting, or wearing.

A further purpose of the second layer is to balance the tension created within the first layer by incorporating a differential in loop density. A knitted component with a differential in loop density and with only one layer would also tend to bend and would not stay flat. This would make further processing difficult and visually not appealing. Therefore, certain articles of apparel or footwear could not be produced.

The first layer may be connected to the second layer by any suitable means, such as knitting, gluing, welding, etc.

The first knitted layer may be connected to the second knitted layer over substantially the entire surface that forms the interface between the first knitted layer and the second knitted layer. By connecting the first knitted layer over substantially the entire surface that forms the interface between the first knitted layer and the second knitted layer, a particularly stable connection may be achieved. This way, even very large differentials, that is differences in the loop density can be maintained. Substantially the entire surface that forms the interface between the first knitted layer and the second knitted layer means in the present context at least 50%, preferably 75%, more preferably 90% of the entire interface neglecting the gaps (e.g. formed between the yarns) is naturally formed by a knitting process.

The fourth linear loop density may be greater than the third linear loop density. In other words, there is also a differential in loop density on the second knitted layer. By providing a differential in loop density also on the second knitted layer, the overall differential for the knitted component is increased. That is, the differences in strength, elasticity, and stiffness between different regions of the knitted component may be larger than would be possible if only the first knitted layer comprises a differential in loop density.

The first direction may be substantially parallel to the second direction. In other words, the direction in which the differential is created in the first knitted layer is parallel to the direction in which the differential is created in the second knitted layer. The advantage is that the differential created in the first knitted layer is reinforced by the differential created in the second knitted layer. By substantially parallel it is meant in the present context, that the first direction forms an angle of preferably less than 30° with the second direction. More preferably, the first direction forms an angle of less than 10° with the second direction.

The first portion and the second portion may comprise at least one shared yarn and/or the third portion and the fourth portion may comprise at least one shared yarn. The differential in loop density may be engineered to occur along the shared yarn. For example, in flat weft knitting the differential in loop density could be engineered along a knitting row, otherwise known as a course. However, a knitted component according to the present invention may also be knitted using warp knitting. If the differential in loop density is engineered to occur along the shared yarn this enables ways of engineering the properties of the knitted component that would not be possible in conventional weft knitting, without the use of the intarsia technique, which has the disadvantages of increased knitting times and potentially higher weight per unit area of fabric. Therefore, the functionality and wearing comfort of a resulting article of apparel or footwear is improved.

The first direction and/or the second direction may be substantially parallel to a wale direction. A variation of the linear loop density measured along a wale direction is particularly useful as the yarns are not arranged primarily along a wale direction in knitting. For example, in weft knitting the yarns generally follow a course direction that is generally perpendicular to a wale direction. With the present invention, the linear loop density measured along a wale direction may be different for one wale than for the adjacent wale, therefore creating a variation of the mechanical properties of the knitted component along a course. In conventional weft knitting, modifying the properties along a course by means of different yarns would only be possible by using the intarsia technique. For this reason, a differential in the loop density along the wale direction is particularly useful. It should be understood that even if the linear loop density along the course direction is the same in the first portion as in the second portion, the knitted component may still be less elastic when pulled along the course direction in the second portion (with the higher linear loop density along the wale direction) than when pulled along the course direction in the first portion. Similarly, even if the linear loop density along the course direction is the same in the third portion as in the fourth portion, the knitted component may still be less elastic when pulled along the course direction in the fourth portion than when pulled along the course direction in the third portion if the fourth linear loop density measured along the wale direction is greater than the third linear loop density measured along the wale direction. Moreover, due to a natural relaxation of the yarn, the variation of the stitch height may entail a certain degree of variation of the linear loop density also along the course. By substantially parallel it is meant in the present context, that the first direction and/or second direction forms an angle of preferably less than 30° with a wale direction. More preferably, the first direction forms an angle of less than 10° with a wale direction.

The first layer and the second layer may be connected by knitting. Connecting the first layer and the second layer by knitting is advantageous because there is no need for an additional process step in which the two layers are connected, for example by means of an adhesive or by welding. Therefore, the production process is simplified and the risk of losing the differential between the process steps of knitting the first and the second layer and connecting the first and the second layer is prevented. Moreover, if the first layer and the second layer were connected by means of an adhesive, the breathability of the knitted component would be deteriorated and therefore it is preferable to connect the first layer and the second layer by knitting.

The first layer and the second layer may be for instance obtained as a unitary construction by means of a single knitting process.

The first layer and the second layer may be connected by means of at least one tuck stitch. A tuck stitch is a basic knitting operation that can be easily and quickly executed on any knitting machine. Furthermore, a tuck stitch provides for a stable connection between the first layer and the second layer.

The first portion on the first layer may be arranged in proximity to the third portion on the second layer and/or the second portion on the first layer may be arranged in proximity of the fourth portion on the second layer. By this arrangement, there is a synergetic effect by which the overall differential in the loop density in the knitted component is enhanced due to the combination of the differentials in the first layer and the second layer. If the first portion on the first layer is arranged in proximity to the third portion on the second layer this means in the present context, that at least one loop in the first portion overlaps with at least one loop in the third portion when viewed along a direction perpendicular to the first and/or second layer. The same applies generally, mutatis mutandis, for the expression "in proximity" herein.

The second linear loop density may be at least 20% larger than the first linear loop density and/or the fourth linear loop density may be at least 20% larger than the third linear loop density. The inventors have found that in order to create a meaningful variation in the stiffness, elasticity, and strength of the knitted component it is preferable for the second linear loop density to be at least 20% larger than the first linear loop density and/or for the fourth linear loop density to be at least 20% larger than the third linear loop density. The inventors have also found that it is more preferable for the second linear loop density to be at least 40% larger than the first linear loop density and/or for the fourth linear loop density to be at least 40% larger than the third linear loop density.

The knitting pattern in the first portion may be the same as the knitting pattern in the second portion and/or the knitting pattern in the third portion may be the same as the knitting pattern in the fourth portion. By using the same knitting pattern in the first portion as in the second portion and/or by using the same knitting pattern in the third portion as in the fourth portion it is possible to reduce the knitting time because the complexity of the knitting process is reduced. It should be emphasized that an advantage of the knitted component according to the present invention is that the knitted component according to the present invention does not require more than one knitting pattern in order for the properties of the knitted component to be engineered to differ across the knitted component, so that the overall knitting process is simplified and the knitting time reduced. For example, a single knitting pattern may be used for the first layer and the second layer.

The type of yarn used in the first portion may be the same as the type of yarn used in the second portion and/or the type of yarn used in the third portion may be the same as the type of yarn used in the fourth portion. An advantage of the present invention is that a knitted component according to the present invention does not require different types of yarn to locally engineer the mechanical properties, such as the elasticity and/or stiffness of the knitted component. The first portion and the second portion may comprise the same type of yarn. A type of yarn is, in the present context, determined by the material (for example cotton, polyester, elastane, and so on), the composition (single filament, multifilament, number of plies etc.), and the weight per unit length measured in denier or dtex, etc.

The third portion and the fourth portion of the second layer may also comprise the same type of yarn. For example, a single type of yarn may be used throughout for all of the first layer and/or all of the second layer. Thus, an article of apparel or footwear manufactured from a knitted component according to the invention may be manufactured from a single material. This improves the recyclability of the apparel or footwear and is therefore more sustainable than a conventional knitted component. Furthermore, the cost of production and the production time is reduced if a single type of yarn, or a reduced number of types of yarn is used. Moreover, further processing of a knitted component according to the invention is improved as the material may be the same throughout the knitted component. However, it is also possible to use different types of yarn within any one of the portions or different types of yarn that differ between different portions.

The yarn used for at least one portion of the knitted component may comprise polyester. The inventors have found that the stability of the differential in the loop density is greatly improved by using yarn including polyester. Polyester yarn tends to be relatively stiff and therefore even very large differentials in the loop density can be maintained securely and permanently.

A surface of the knitted component may be substantially free of any coating. A coating, for example a polymer coating, could be used to create a variation in properties, such as stiffness, elasticity, and strength across the knitted component. However, applying a coating requires an additional process step and therefore makes the production more complicated and expensive. Furthermore, coating the knitted component deteriorates its breathability. A knitted component according to the present invention does not require any coating and therefore, for the reasons outlined, it is preferably not coated. By substantially free of any coating means in the present context that preferably less than 30% of the surface of the knitted component have a coating applied. More preferably, less than 15% of the surface of the knitted component have a coating applied.

The yarn used for at least one portion of the knitted component may comprise a melted meltable component. An alternative or additional way of stabilizing the differential in loop density is to incorporate a meltable component into the knitted component. For example, a melt yarn, also known as fuse yarn, may be incorporated easily during the knitting process. For example, a thread comprising two plies of polyamide yarn with a melting temperature of 85° C. and 840 dtex is a suitable melt yarn.

The knitted component may be weft knitted. Weft knitting produces generally more elastic fabric than warp knitting and thus the range of elasticity that can be created in a knitted component according to the present invention is greater with weft knitting than with warp knitting. Furthermore, weft knitting allows for a simpler production of a knitted component according to the present invention. In weft knitting, the cam system can be suitably modified using methods that are known in the prior art in order to allow the stitch length, or stitch height, to be varied even across a single course or between one course and another course.

The knitted component may be knitted on a flat knitting machine using at least two needle beds. A flat knitting machine comprising at least two needle beds allows for a particularly simple and efficient production of a knitted component according to the present invention. Preferably, the first needle bed knits the first layer while the second needle beds knits the second layer simultaneously. It is therefore possible to produce a knitted component according to the present invention within a single process step, i.e. as a unitary construction. A big advantage of using a flat knitting machine is that the first portion and the second portion with their different mechanical properties may be located on the same row, or course, or the same wale. This allows specific areas with desired mechanical properties to be engineered into the knitted component.

The knitted component according to the present invention may alternatively be produced on a circular knitting machine with a double cylinder.

The invention further concerns an article of apparel comprising a knitted component according to the invention as disclosed herein. The article of apparel may have stiff regions and elastic regions in order to provide the right level of flexibility and support wherever required. For example, it is possible to produce a shirt with long sleeves comprising a knitted component, wherein the sleeves are stiff and provide strong support in the shoulder region in order to prevent injuries during exercise, while the elbow region of the sleeve is engineered to be elastic and flexible allowing the elbow to be bent easily.

The invention further concerns an upper for an article of footwear comprising a knitted component according to the invention as disclosed herein. An upper comprising a knitted component according to the invention is lightweight and provides the right level of support and the right flexibility where required. For example, the upper may be quite stiff in a toe region, a heel region, or a metatarsal region in order to prevent injuries while it could be elastic in an instep region in order to allow a wearer to insert his foot and for a good performance during exercise, for example during running.

The invention further concerns an article of footwear comprising an upper as described herein and further comprising a sole. The article of footwear is lightweight and provides the right level of support and the right flexibility where required. For example, the article of footwear may be quite stiff in a toe region, a heel region, or a metatarsal region in order to prevent injuries while it could be elastic in an instep region in order to enable easy entry of a foot of a wearer and to enable good performance during exercise, for example during running. The sole provides addition protection and support especially for the bottom of the foot.

The invention further concerns a method for producing a knitted component, especially for an article of apparel or footwear, comprising: (a) knitting a first knitted layer, comprising: knitting a first portion with a first stitch height along a first direction, knitting a second portion with a second stitch height along the first direction, wherein the second stitch height is smaller than the first stitch height; (b) knitting a second knitted layer, comprising: knitting a third portion with a third stitch height along a second direction, knitting a fourth portion with a fourth stitch height along the second direction; and (c) connecting the first knitted layer to the second knitted layer.

A knitted component according to the present invention may be used for any article of apparel or footwear. A knitted component according to the present invention may also find applications for example in medical bandages to prevent or treat injuries.

It is to be understood that a knitted component according to the present invention may comprise any number of layers greater than or equal to two, for example a knitted component according to the present invention may comprise two layers, as another example a knitted component according to the present invention may comprise three layers.

A knitted component according to the present invention may be manufactured using warp knitting or weft knitting. The stitch length is the length of yarn which includes one needle loop and half the length of yarn, i.e. half a sinker loop, between that needle loop and the adjacent needle loops on either side of it. The stitch height is the corresponding height of the knitted loop along the wale. Therefore, in the present invention, varying the stitch height has the same effect as varying the stitch length and both expressions are used to describe the present invention. In practice, the stitch height is controlled by what the skilled person usually refers to as needle sinker position (NSP), i.e. the position of the cam system during knitting.

A knitted component according to the present invention may be manufactured using weft knitting and the height of the stitches may be varied along the same row.

It is also to be understood that the first portion and the second portion with their first and second stitch height are formed systematically in the knitted component and not by accident, for example by a knitting error. Preferably, the first portion and the second portion occupy at least 5% each of the total area of the first layer of the knitted component. More preferably, the first portion and the second portion occupy at least 20% each of the total area of the first layer of the knitted component. For example, the first portion may occupy 20% of the total area of the first layer while the second portion may occupy 80% of the total area of the first layer. It is important to note, that the variation in stitch height may be gradual from the first portion to the second portion. In this case, half of the area over which the stitch height varies should be considered as being part of the first portion and the other half of that area should be considered as being part of the second portion for the purpose of calculating the area of the first portion and of the second portion.

For the first knitted layer, since the second stitch height in the second portion is smaller than the first stitch height in the first portion, the second portion generally has a greater stiffness and thus greater strength than the first portion. This is because the resulting linear loop density in the second portion is larger than the linear loop density in the first portion. Thus, the properties of the knitted component can be engineered to provide the right amount of strength and stiffness in certain regions and sufficient flexibility and elasticity in other regions.

However, the length of a loop on a finished article of apparel or footwear does not have to be identical to the stitch length during knitting. The reason for that is that the knitted loop may shrink or expand during further processing or while an article of apparel or footwear, which comprises a knitted component according to the invention, is being worn. For example, a knitted loop may shrink or expand during bleaching or washing of the knitted component. A knitted loop may also shrink or expand when an upper comprising a knitted component according to the invention is lasted on a last and processed, for example by applying heat.

The primary purpose of the second layer is to stabilize the differential in loop density resulting from the different stitch height. By differential it is meant in the present context, any variation between the first portion and the second portion, and/or a third portion and a fourth portion. Without a second layer, the differential in loop density could not be maintained during processing of the knitted component or during normal use for example during washing or wearing of an article of apparel or footwear comprising the knitted component. For example, the differential may be lost during bleaching of the knitted component or when an upper comprising the knitted component is lasted on a last. The inventors have found that by connecting first knitted layer to the second knitted layer, the differential in loop density can be permanently and securely maintained even during bleaching, washing, lasting, or wearing.

A further purpose of the second layer is to balance the tension created within the first layer by incorporating a differential in loop density. A knitted component with a differential in loop density and with only one layer would also tend to bend and would not stay flat. This would make further processing difficult and visually not appealing. Therefore, certain articles of apparel or footwear could not be produced.

The first layer may be connected to the second layer by any suitable means, such as knitting, gluing, welding, etc.

Connecting the first knitted layer to the second knitted layer may be done over substantially the entire surface that forms the interface between the first knitted layer and the second knitted layer. By connecting the first knitted layer over substantially the entire surface that forms the interface between the first knitted layer and the second knitted layer, a particularly stable connection may be achieved. This way, even very large differentials, that is differences in the loop density can be maintained. Substantially the entire surface that forms the interface between the first knitted layer and the second knitted layer means in the present context at least 50%, preferably 75%, more preferably 90% of the entire interface neglecting the gaps (e.g. formed between the yarns) naturally formed by a knitting process.

The fourth stitch height may be smaller than the third stitch height. In other words, there is also a differential in loop density on the second knitted layer. By providing a differential in loop density also on the second knitted layer, the overall differential for the knitted component is increased. That is, the differences in strength, elasticity, and stiffness between different regions of the knitted component may be larger than would be possible if only the first knitted layer comprises a differential in loop density.

The first direction may be substantially parallel to the second direction. In other words, the direction in which the differential is created in the first knitted layer is parallel to the direction in which the differential is created in the second knitted layer. The advantage is that the differential created in the first knitted layer is reinforced by the differential created in the second knitted layer. By substantially parallel it is meant in the present context, that the first direction forms an angle of preferably less than 30° with the second direction. More preferably, the first direction forms an angle of less than 10° with the second direction.

The first portion and the second portion may comprise at least one shared yarn and/or the third portion and the fourth portion may comprise at least one shared yarn. The different stitch heights may be used on the shared yarn. For example, in flat weft knitting different stitch heights can be used along one knitting row, otherwise known as a course. However, a knitted component according to the present invention may also be knitted using warp knitting. If the differential in loop density is engineered to occur along the shared yarn this enables ways of engineering the properties of the knitted component that would not be possible in conventional weft knitting, without the use of the intarsia technique, which has the disadvantages of increased knitting times and potentially higher weight per unit area of fabric. Therefore, the functionality and wearing comfort of a resulting article of apparel or footwear is improved.

The first direction and/or the second direction may be substantially parallel to a wale direction. A variation of stitch height along a wale direction is particularly useful as the yarns are not arranged primarily along a wale direction in knitting. For example, in weft knitting the yarns generally follow a course direction that is generally perpendicular to a wale direction. With the present invention, the linear loop density measured along a wale direction may be different for one wale than for the adjacent wale, therefore creating a variation of the mechanical properties of the knitted component along a course. In conventional weft knitting, modifying the properties along a course by means of different yarns would only be possible by using the intarsia technique. For this reason, a differential in the loop density along the wale direction is particularly useful. It should be understood that even if the linear loop density along the course direction is the same in the first portion as in the second portion, the knitted component may still be less elastic when pulled along the course direction in the second portion (with the higher linear loop density along the wale direction) than when pulled along the course direction in the first portion. Similarly, even if the linear loop density along the course direction is the same in the third portion as in the fourth portion, the knitted component may still be less elastic when pulled along the course direction in the fourth portion than when pulled along the course direction in the third portion if the fourth linear loop density measured along the wale direction is greater than the third linear loop density measured along the wale direction. Moreover, due to a natural relaxation of the yarn, the variation of the stitch height may entail a certain degree of variation of the linear loop density also along the course. By substantially parallel it is meant in the present context, that the first direction and/or second direction forms an angle of preferably less than 30° with a wale direction. More preferably, the first direction forms an angle of less than 10° with a wale direction.

Connecting the first layer and the second layer may be done by knitting. Connecting the first layer and the second layer by knitting is advantageous because there is no need for an additional process step in which the two layers are connected, for example by means of an adhesive or by welding. Therefore, the production process is simplified and the risk of losing the differential between the process steps of knitting the first and the second layer and connecting the first and the second layer is prevented. Moreover, if the first layer and the second layer were connected by means of an adhesive, the breathability of the knitted component would be deteriorated and therefore it is preferable to connect the first layer and the second layer by knitting.

Connecting the first layer and the second layer may comprise knitting the first and the second layer together as a unitary construction on a single knitting process.

Connecting the first layer and the second layer may comprise knitting at least one tuck stitch. A tuck stitch is a basic knitting operation that can be easily and quickly executed on any knitting machine. Furthermore, a tuck stitch provides for a stable connection between the first layer and the second layer.

The method may comprise arranging the first portion on the first layer in proximity of the third portion on the second layer; and/or arranging the second portion on the first layer in proximity of the fourth portion on the second layer. By this arrangement, there is a synergetic effect by which the overall differential in the loop density in the knitted component is enhanced due to the combination of the differentials in the first layer and the second layer. If the first portion on the first layer is arranged in proximity to the third portion on the second layer this means in the present context, that at least one loop in the first portion overlaps with at least one loop in the third portion when viewed along a direction perpendicular to the first and/or second layer. The same applies generally, mutatis mutandis, for the expression "in proximity" herein.

The first stitch height may be at least 20% larger than the second stitch height and/or the third stitch height may be at least 20% larger than the fourth stitch height. The inventors have found that in order to create a meaningful variation in the stiffness, elasticity, and strength of the knitted component it is preferable for the first stitch height to be at least 20% larger than the second stitch height and/or for the third stitch height to be at least 20% larger than the fourth stitch height. The inventors have also found that it is more preferable for the first stitch height to be at least 40% larger than the second stitch height and/or for the third stitch height to be at least 40% larger than the fourth stitch height.

The knitting pattern in the first portion may be the same as the knitting pattern in the second portion and/or the knitting pattern in the third portion may be the same as the knitting pattern in the fourth portion. By using the same knitting pattern in the first portion as in the second portion and/or by using the same knitting pattern in the third portion as in the fourth portion it is possible to reduce the knitting time because the complexity of the knitting process is reduced. It should be emphasized that an advantage of the knitted component according to the present invention is that the knitted component according to the present invention does not require more than one knitting pattern in order for the properties of the knitted component to be engineered to differ across the knitted component. For example, a single knitting pattern may be used for the first layer and the second layer.

The type of yarn used in the first portion may be the same as the type of yarn used in the second portion and/or the type of yarn used in the third portion may be the same as the type of yarn used in the fourth portion. An advantage of the present invention is that a knitted component according to the present invention does not require different types of yarn to locally engineer the mechanical properties of the knitted component. The first portion and the second portion may comprise the same type of yarn. A type of yarn is, in the present context, determined by the material (for example cotton, polyester, elastane, and so on), the composition (single filament, multifilament, number of plies etc.), and the weight per unit length measured in denier or dtex, etc. The third portion and the fourth portion of the second layer may also comprise the same type of yarn. For example, a single type of yarn may be used throughout for all of the first layer and/or all of the second layer. Thus, an article of apparel or footwear manufactured from a knitted component according to the invention may be from manufactured from a single material. This improves the recyclability of the apparel or footwear and is therefore more sustainable than a conventional knitted component. Furthermore, the cost of production and the production time is reduced if a single type of yarn, or a reduced number of types of yarn is used. Moreover, further processing of a knitted component according to the invention is improved as the material may be the same throughout the knitted component. However, it is also possible to use different types of yarn within any one of the portions or different types of yarn that differ between different portions.

The yarn used for at least one portion of the knitted component may comprise polyester. The inventors have found that the stability of the differential in the loop density is greatly improved by using yarn including polyester. Polyester yarn tends to be relatively stiff and therefore even very large differentials in the loop density can be maintained securely and permanently.

A surface of the knitted component may be substantially free of any coating. A coating, for example a polymer coating, could be used to create a variation in properties, such as stiffness, elasticity, and strength across the knitted component. However, applying a coating requires an additional process step and therefore makes the production more complicated and expensive. Furthermore, coating the knitted component deteriorates its breathability. A knitted component according to the present invention does not require any coating and therefore, for the reasons outlined, it is preferably not coated. By substantially free of any coating means in the present context that preferably less than 30% of the surface of the knitted component have a coating applied. More preferably, less than 15% of the surface of the knitted component have a coating applied.

The yarn used for at least one portion of the knitted component may comprise a melted meltable component. An alternative or additional way of stabilizing the differential in loop density is to incorporate a meltable component into the knitted component. For example, a melt yarn, also known as fuse yarn, may be incorporated easily during the knitting process. For example, a thread comprising two plies of polyamide yarn with a melting temperature of 85° C. and 840 dtex is a suitable melt yarn.

Knitting may be performed using weft knitting. Weft knitting produces generally more elastic fabric than warp knitting and thus the range of elasticity that can be created in a knitted component according to the present invention is greater with weft knitting than with warp knitting. Furthermore, weft knitting allows for a simpler implementation of the method according to the present invention. In weft knitting, the cam system can be suitably modified using methods that are known in the prior art in order to allow the stitch length, or stitch height, to be varied even across a single course or between one course and another course.

The knitted component may be knitted on a flat knitting machine using at least two needle beds. A flat knitting machine comprising at least two needle beds allows for a particularly simple and efficient implementation of the method according to the present invention. Preferably the first needle bed substantially knits the first layer while the second needle beds knits the second layer simultaneously. However, some of the stitches may be knitted on one needle bed and then transferred to the other. It is therefore possible to produce a knitted component according to the present invention within a single process step. A big advantage of using a flat knitting machine is that the first portion and the second portion with their different mechanical properties may be located on the same row, or course, or the same wale. This allows specific areas with desired mechanical properties to be engineered into the knitted component.

The knitted component according to the present invention may alternatively be produced on a circular knitting machine with a double cylinder.

The invention further concerns a method for producing an article of apparel comprising producing a knitted component according to a method of the present invention. The article of apparel may be produced in a single step by a three-dimensional knitting process, for example using a flat knitting machine comprising at least two needle beds. The article of apparel may have stiff regions and elastic regions in order to provide the right level of flexibility and support wherever required. For example, it is possible to produce a shirt with long sleeves comprising a knitted component, wherein the sleeves are stiff and provide strong support in the shoulder region in order to prevent injuries during exercise, while the elbow region of the sleeve is engineered to be elastic and flexible allowing the elbow to be bent easily.

The invention further concerns a method for producing an upper for an article of footwear comprising (a) providing a knitted component according to the invention as described herein, (b) lasting the knitted component. The upper is lightweight and provides the right level of support and the right flexibility where required. Lasting the knitted component improves the fit to the foot. The operation of lasting the upper has the additional advantage that it can be used to consolidate and increase the stability of the differential in the linear loop density, for example when the upper is knitted with melt yarns and the melt yarns are melted by application of heat while the upper is arranged on the last.

The invention further concerns a method for producing an article of footwear comprising: (a) providing an upper according to the invention as disclosed herein and (b) attaching a sole to the upper. An article of footwear comprising a knitted component according to the invention is lightweight and provides the right level of support and the right flexibility where required. For example, the article of footwear may be quite stiff in a toe region, a heel region, or a metatarsal region in order to prevent injuries while it could be elastic in an instep region in order to enable easy entry for the foot of a wearer and to enable a good performance during exercise, for example during running. The sole provides additional stability and protection for the foot, especially for the underside of the foot. The sole may be attached while the upper is lasted or the sole may be attached after completing the lasting of the upper.

SHORT DESCRIPTION OF THE FIGURES

Figure 1B:
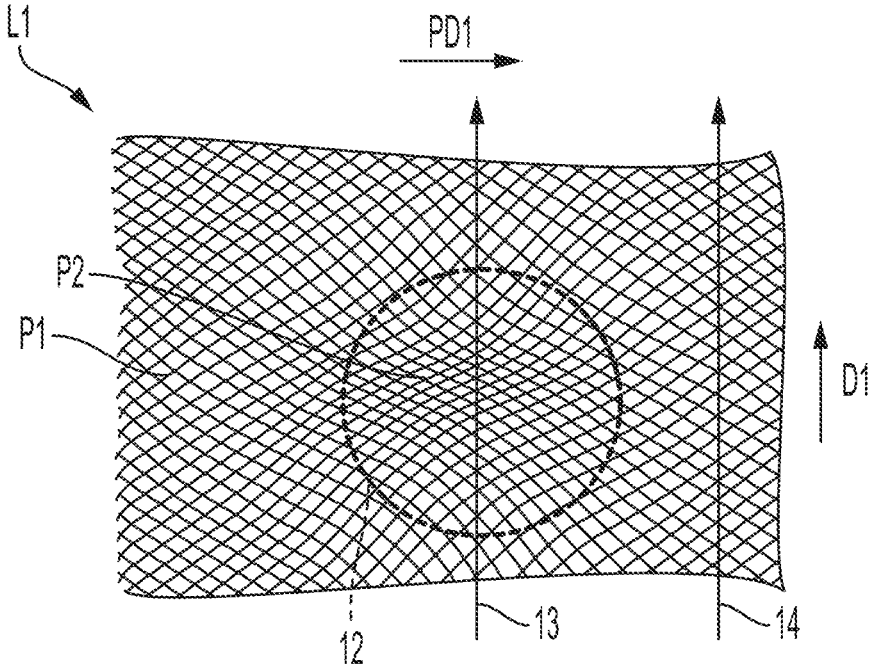
Figure 1C:
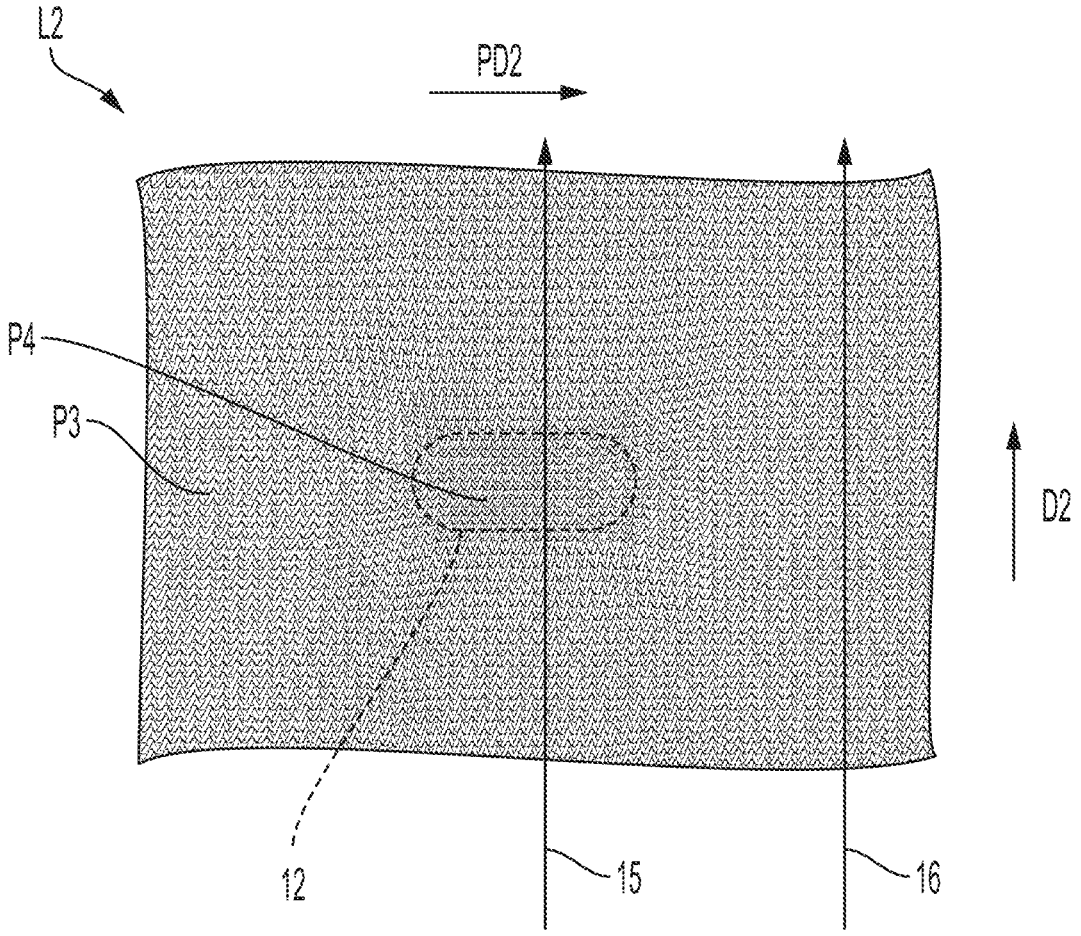

In the following, the invention will be described in more detail with reference to the following figures:

FIGS. 1A-C: an exemplary knitted component according to the invention.

Figure 2A:
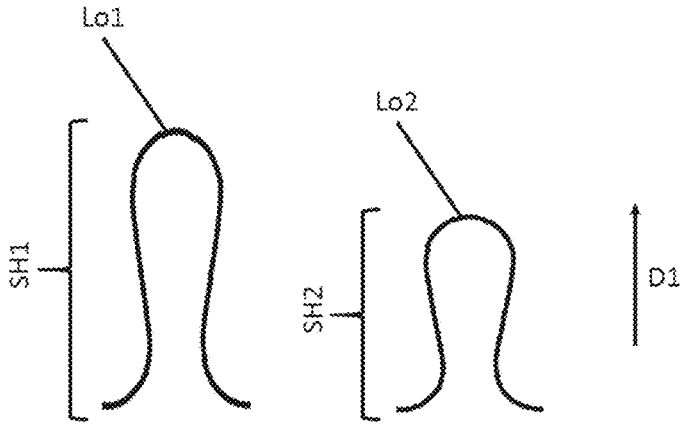
Figure 2B:
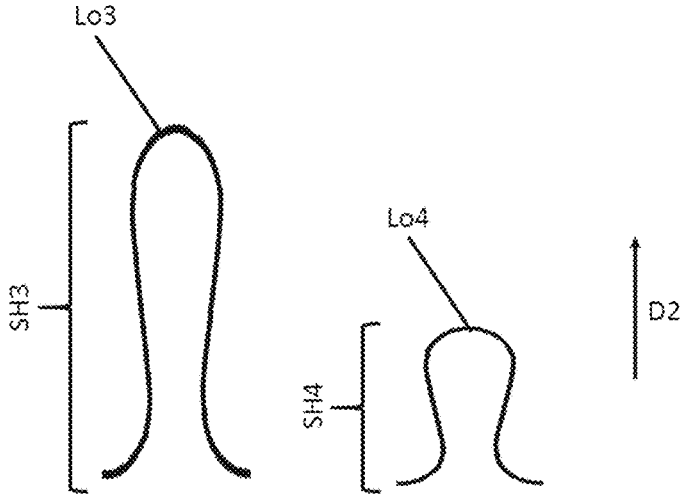
Figure 2C:
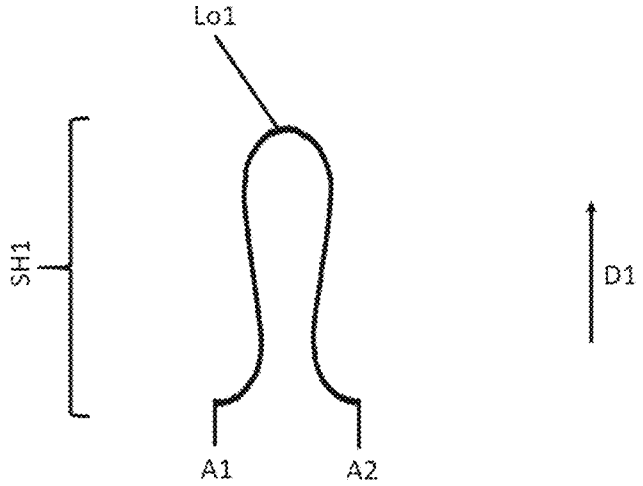

FIGS. 2A, B, C: an exemplary single loop configuration for the first and the second portion (FIG. 2A) and the third and the fourth portion (FIG. 2B); an illustration of the stitch length and stitch height of a single loop (FIG. 2C).

Figure 3A:
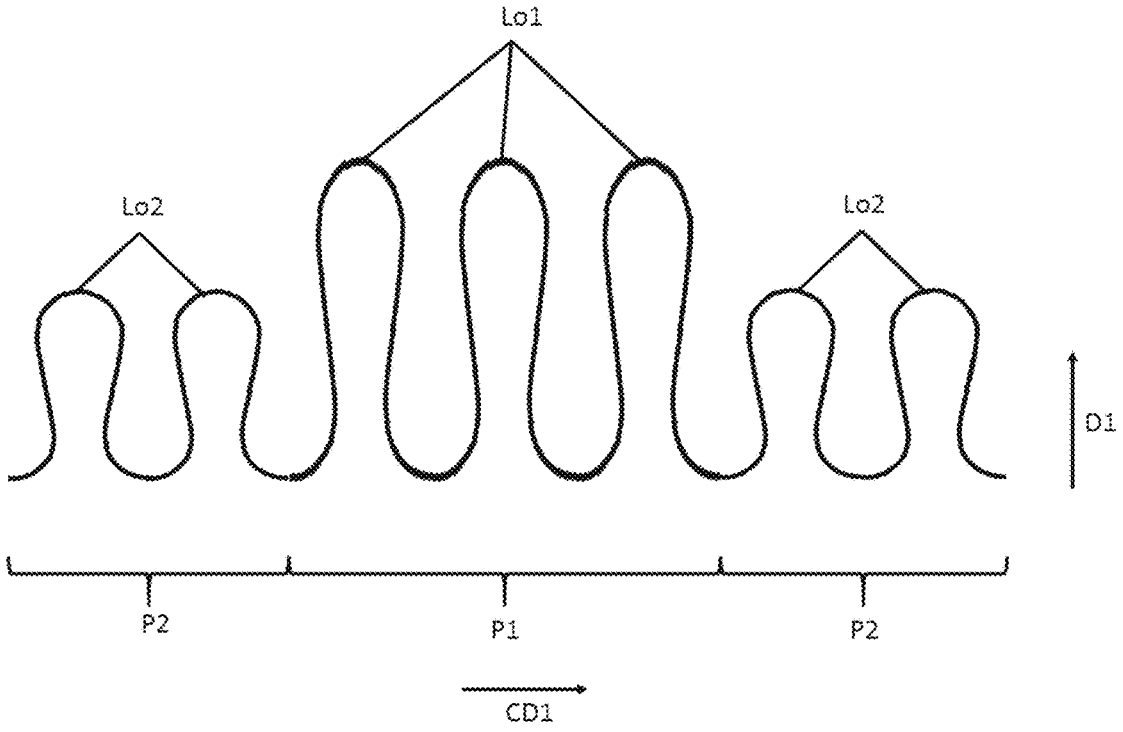
Figure 3B:
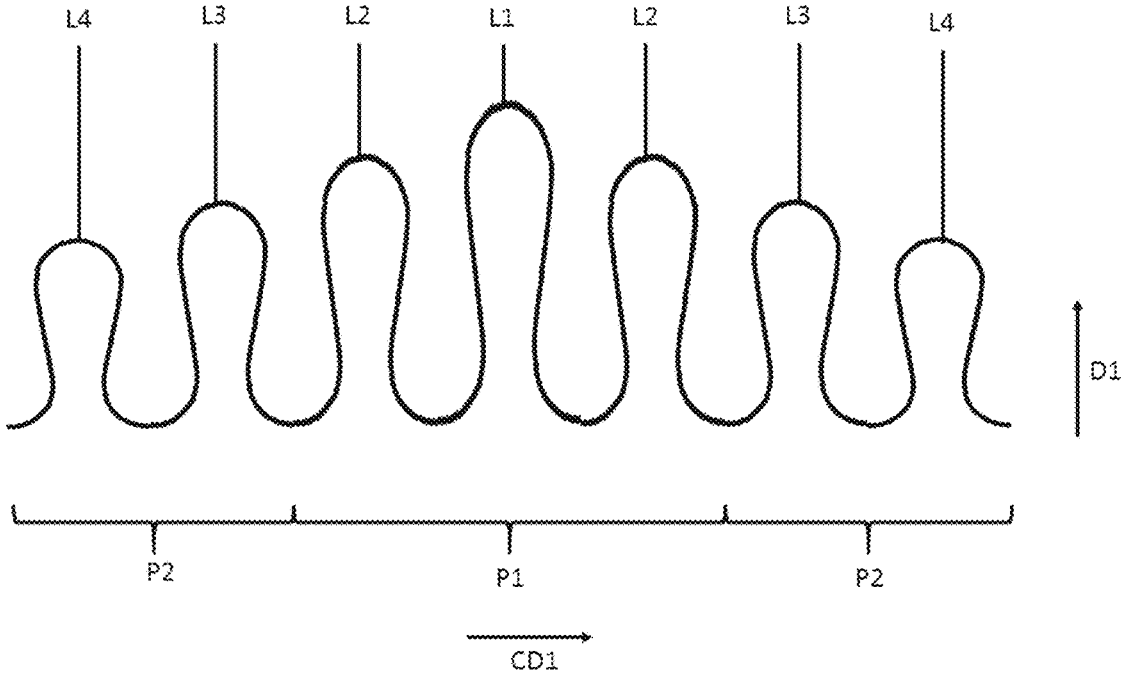

FIGS. 3A, B: an exemplary knitting yarn configuration for the first portion and the second portion showing an exemplary step-like differential (FIG. 3A) and an exemplary gradual differential (FIG. 3B).

Figure 4:
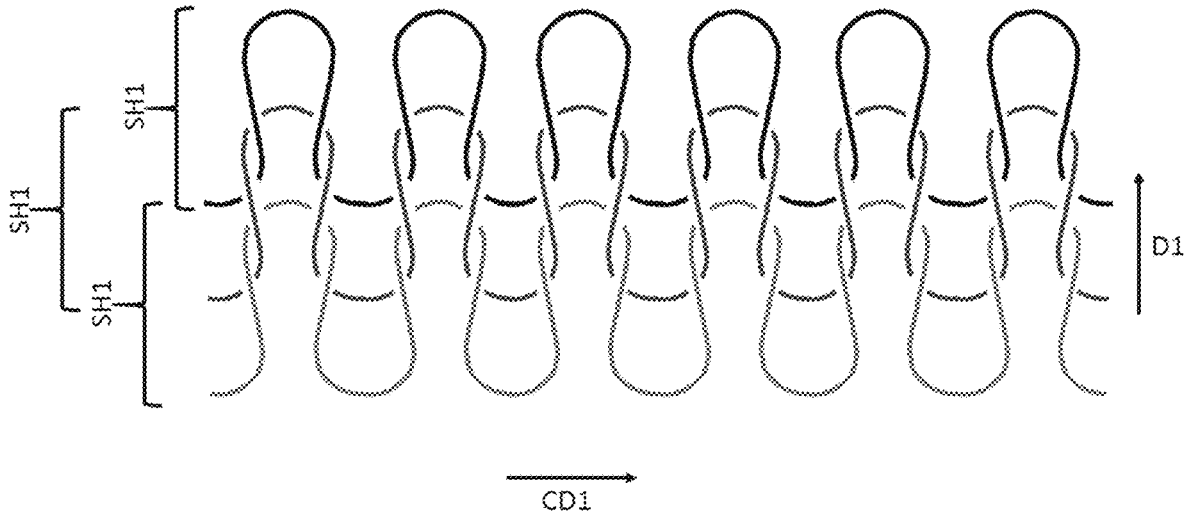

FIG. 4: an exemplary knitting pattern as known in the prior art.

Figure 5A:
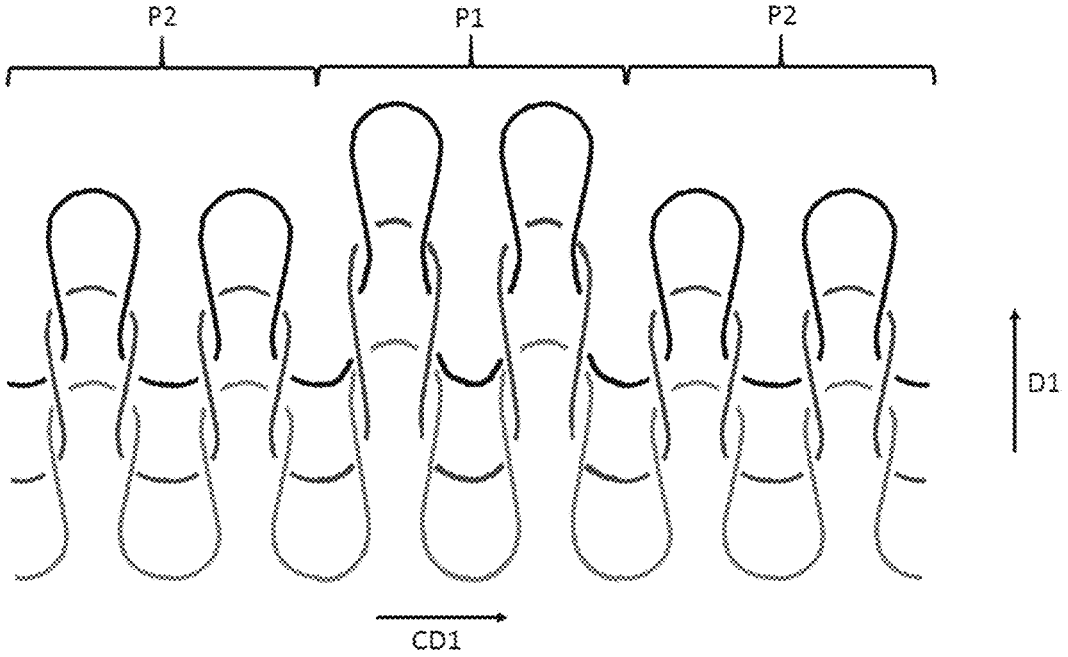

FIGS. 5A, B: exemplary knitting patterns according to the invention.

Figure 6A:
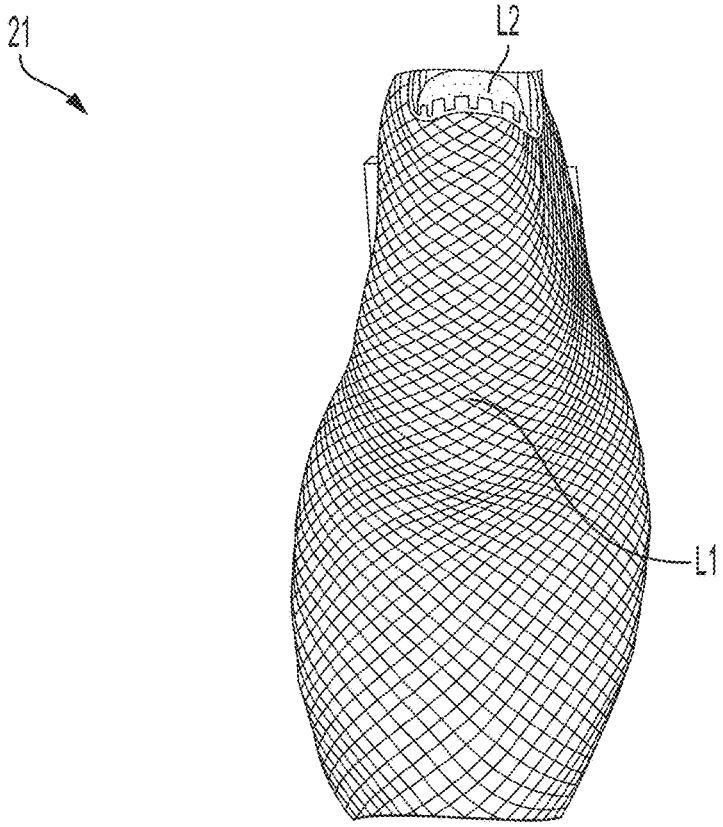

FIGS. 6A, B: exemplary shoes according to the invention.

DETAILED DESCRIPTION OF PREFERRED EMBODIMENTS

In the following only some exemplary embodiments of the invention are described in detail. The person skilled in the art should be aware that these exemplary embodiments can be modified in a number of ways and combined with each other whenever compatible and that certain features may be omitted in so far as they appear dispensable.

FIGS. 1A-C show an exemplary knitted component 11 according to the invention. The knitted component 11 comprises: (a) a first knitted layer L1 (shown in FIG. 1A and FIG. 1B), comprising a knitted first portion P1 with a first linear loop density along a first direction D1, a knitted second portion P2 with a second linear loop density along the first direction D1, wherein the second linear loop density is greater than the first linear loop density; (b) a second knitted layer L2 (shown in FIG. 1A and FIG. 1C), comprising a knitted third portion P3 with a third linear loop density along a second direction D2, a knitted fourth portion P4 with a fourth linear loop density along the second direction D2; wherein the first knitted layer L1 is connected to the second knitted layer L2.

As shown in FIG. 1B, there is a border 12 between the first portion P1 and the second portion P2. The border 12 surrounds the second portion P2 on all sides. However, it is also possible that the second portion P2 is located close to an edge or a corner of the knitted component and that therefore, the border 12 does not surround the second portion P2 on all sides. The same applies, mutatis mutandis, for the first portion P1.

Moreover, a transition portion could be interposed between the second portion P2 and the first portion P1.

A knitted component 11 according to the present invention may be used for any article of apparel or footwear. A knitted component 11 according to the present invention may also find applications for example in medical bandages to prevent or treat injuries.

While the exemplary knitted component 11 in FIG. 1 comprises two layers, it is to be understood that a knitted component 11 according to the present invention may comprise any number of layers greater than or equal to two.

The linear loop density is the density of loops measured along a linear direction, which may be a wale direction. The smallest length scale on which a meaningful loop density can be measured is given by two loops interlocked by knitting. In this case, the linear loop density is the inverse of the distance between corresponding elements of the two loops, for example the inverse of the distance between the apex of the first loop and the apex of the second loop, wherein the apex is located at the top of a loop. The first direction D1 is the direction along which the linear loop density is determined. As shown in FIG. 1B, the linear loop density along the line 13, which is parallel to D1, is not constant as the line 13 cuts through both the first portion P1 and the second portion P2. However, the linear loop density along line 14, which is parallel to D1, is approximately constant, apart from some small fluctuations due to manufacturing imperfections and some tension in the fabric emanating primarily from the second region P2.

It is to be understood that the description of the knitted component 11 herein pertains to a knitted component 11 in an equilibrium state without any external tension in any direction being applied. It is also to be understood that the first portion P1 and the second portion P2 with their different linear loop density are formed systematically in the knitted component 11 and not by accident, for example by a knitting error. Preferably, the first portion P1 and the second portion P2 occupy at least 5% each of the total area of the first layer L1 of the knitted component 11. More preferably, the first portion P1 and the second portion P2 occupy at least 20% each of the total area of the first layer L1 of the knitted component 11. The differential in linear loop density is also not due to random fluctuations due to, for example, manufacturing imperfections. Preferably, the first portion and the second portion each comprise at least three adjacent knitted loops. More preferably, the first portion and the second portion each comprise at least five adjacent knitted loops. It is important to note, that the variation in loop density may be gradual between the first portion P1 and the second portion P2. In this case, half of the area over which the loop density varies gradually should be considered as being part of the first portion P1 and the other half of that area should be considered as being part of the second portion P2 for the purpose of calculating the area of the first portion P1 and of the second portion P2. By this method, the exemplary first layer L1 in FIG. 1B, the first portion P1 occupies approximately 85% of the total area of the first layer L1 while the second portion P2 occupies 15% of the total area of the first layer L1. This is illustrated in more detail in FIG. 3B. Correspondingly, half of the number of loops in the region of gradual variation should be considered as being part of the first portion and the other half of those loops should be considered as being part of the second portion for the purpose of calculating the number of loops of the first portion and of the second portion.

For the first knitted layer L1, since the second linear loop density in the second portion P2 is greater than the first linear loop density in the first portion P1, the second portion P2 generally has a greater stiffness and thus greater strength than the first portion P1. Thus, the properties of the knitted component 11 can be engineered to provide the right amount of strength and stiffness in certain regions and sufficient flexibility and elasticity in other regions.

An advantage of the present invention is that a knitted component 11 according to the present invention does not require different types of yarn to locally engineer the mechanical properties of the knitted component 11.

Another advantage of the knitted component 11 according to the present invention is that the knitted component 11 according to the present invention does not require more than one knitting pattern in order for the properties of the knitted component 11 to be engineered to differ across the knitted component 11.

A knitted component 11 according to the present invention does not require any type of coating, such as a polymer coating, in order for its properties to be engineered locally. Therefore, an additional process step of applying a coating is not required thus simplifying the production of apparel or footwear comprising a knitted component 11. In addition, the breathability and thus the wearing comfort of a knitted component 11 according to the present invention is improved over a coated knitted component 11, for which the coating deteriorates the breathability of the material.

A knitted component 11 according to the present invention may be manufactured using warp knitting or weft knitting. The loop density can be controlled by controlling the stitch height or stitch length during the knitting process. The stitch length is the length of yarn which includes one needle loop and half the length of yarn, i.e. half a sinker loop, between that needle loop and the adjacent needle loops on either side of it. The stitch height is the corresponding height of the knitted loop along the wale. Therefore, in the present invention, varying the stitch height has the same effect as varying the stitch length and both expressions are used to describe the present invention. In practice, the stitch height is controlled by what the skilled person usually refers to as needle sinker position (NSP), i.e. the position of the cam system during knitting.

However, the length of a loop on a finished article of apparel or footwear does not have to be identical to the stitch length during knitting. The reason for that is that the knitted loop may shrink or expand during further processing or while an article of apparel or footwear, which comprises a knitted component 11 according to the invention, is being worn. For example, a knitted loop may shrink or expand during bleaching or washing of the knitted component 11. A knitted loop may also shrink or expand when an upper comprising a knitted component 11 according to the invention is lasted on a last and processed, for example by applying heat.

The primary purpose of the second layer L2 is to stabilize the differential in loop density i.e. the stitch height or stitch length. By differential it is meant in the present context, any variation between the first portion P1 and the second portion P2, and/or a third portion P3 and a fourth portion P4. Without a second layer L2, the differential in loop density could not be maintained during processing of the knitted component 11 or during normal use for example during washing or wearing of an article of apparel or footwear comprising the knitted component 11. For example, the differential may be lost during bleaching of the knitted component 11 or when an upper comprising the knitted component 11 is lasted on a last. The inventors have found that by connecting first knitted layer L1 to the second knitted layer L2, the differential in loop density can be permanently and securely maintained even during bleaching, washing, lasting, or wearing.

A further purpose of the second layer L2 is to balance the tension created within the first layer L1 by incorporating a differential in loop density. A knitted component with a differential in loop density and with only one layer would also tend to bend and would not stay flat. This would make further processing difficult and visually not appealing. Therefore, certain articles of apparel or footwear could not be produced.

The first layer L1 may be connected to the second layer L2 by any suitable means, such as knitting, gluing, welding, etc.

The first knitted layer L1 is be connected to the second knitted layer L2 over substantially the entire surface that forms the interface between the first knitted layer L1 and the second knitted layer L2. By connecting the first knitted layer L1 over substantially the entire surface that forms the interface between the first knitted layer L1 and the second knitted layer L2, a particularly stable connection may be achieved. This way, even very large differentials, that is differences in the loop density can be maintained. Substantially the entire surface that forms the interface between the first knitted layer and the second knitted layer means in the present context at least 50%, preferably 75%, more preferably 90% of the entire interface neglecting the gaps (e.g. formed between the yarns) naturally formed by a knitting process. However, the first knitted layer does not have to be connected to the second knitted layer L2 over substantially the entire surface that forms the interface between the first knitted layer L1 and the second knitted layer L2.

As shown in FIG. 1C, the fourth linear loop density in the fourth portion P4 is greater than the third linear loop density in the third portion P3. In other words, there is also a differential in loop density on the second knitted layer L2. As shown in FIG. 1C, there is a border 12 between the third portion P3 and the fourth portion P4. The border 12 surrounds the fourth portion P4 on all sides. However, it is also possible that the fourth portion P4 is located close to an edge or a corner of the knitted component and that therefore, the border 12 does not surround the fourth portion P4 on all sides. The same applies, mutatis mutandis, for the third portion P3.

The second direction D2 is the direction along which the linear loop density is determined. As shown in FIG. 1C, the linear loop density along the line 15, which is parallel to D2, is not constant as the line 15 cuts through both the third portion P3 and the fourth portion P4. However, the linear loop density along line 16, which is parallel to D1, is approximately constant, apart from some small fluctuations due to manufacturing imperfections and some tension in the fabric emanating primarily from the fourth region P4. By providing a differential in loop density also on the second knitted layer L2, the overall differential for the knitted component 11 is increased. That is, the differences in strength, elasticity, and stiffness between different regions of the knitted component 11 may be larger than would be possible if only the first knitted layer L1 comprises a differential in loop density. However, the fourth linear loop density in the fourth portion does not need to be greater than the third linear loop density in the third portion.

For the exemplary knitted element 11, the first direction D1 is substantially parallel to the second direction D2. In other words, the direction in which the differential is created in the first knitted layer L1 is parallel to the direction in which the differential is created in the second knitted layer L2. The advantage is that the differential created in the first knitted layer L1 is reinforced by the differential created in the second knitted layer L2. By substantially parallel it is meant in the present context, that the first direction D1 forms an angle of preferably less than 30° with the second direction D2. More preferably, the first direction D1 forms an angle of less than 10° with the second direction D2. However, first direction D1 does not have to be substantially parallel to the second direction D2.

The first portion P1 and the second portion P2 comprise at least one shared yarn and the third portion P3 and the fourth portion P4 comprise at least one shared yarn. In other words, the differential in loop density may be engineered to occur along the shared yarn. For example, in flat weft knitting the differential in loop density could be engineered along a knitting row, otherwise known as a course. However, a knitted component 11 according to the present invention may also be knitted using warp knitting. If the differential in loop density is engineered to occur along the shared yarn this enables ways of engineering the properties of the knitted component that would not be possible in conventional weft knitting, without the use of the intarsia technique, which has the disadvantages of increased knitting times and potentially higher weight per unit area of fabric. Therefore, the functionality and wearing comfort of a resulting article of apparel or footwear is improved. However, the first portion P1 and the second portion P2 do not need to comprise at least one shared yarn and the third portion P3 and the fourth portion P4 do not need to comprise at least one shared yarn.

In the exemplary knitted component 11, the first direction D1 and the second direction D2 are substantially parallel to a wale direction. A variation of the linear loop density measured along a wale direction is particularly useful as the yarns are not arranged primarily along a wale direction in knitting. For example, in weft knitting the yarns generally follow a course direction that is generally perpendicular to a wale direction. With the present invention, the linear loop density measured along a wale direction may be different for one wale than for the adjacent wale, therefore creating a variation of the mechanical properties of the knitted component along a course. In conventional weft knitting, modifying the properties along a course by means of different yarns would only be possible by using the intarsia technique. For this reason, a differential in the loop density measured along the wale direction is particularly useful. In this case, the course direction would be along the direction PD1, which is perpendicular to D1, on the first layer and the course direction would be along the direction PD2, which is perpendicular to D2, on the second layer. It should be understood that even if the linear loop density along the course direction is the same in the first portion as in the second portion, the knitted component may still be less elastic when pulled along the course direction in the second portion (with the higher linear loop density along the wale direction) than when pulled along the course direction in the first portion. Similarly, even if the linear loop density along the course direction is the same in the third portion as in the fourth portion, the knitted component may still be less elastic when pulled along the course direction in the fourth portion than when pulled along the course direction in the third portion if the fourth linear loop density measured along the wale direction is greater than the third linear loop density measured along the wale direction. Moreover, due to a natural relaxation of the yarn, the variation of the stitch height may entail a certain degree of variation of the linear loop density also along the course. By substantially parallel it is meant in the present context, that the first direction D1 and/or second direction D2 forms an angle of preferably less than 30° with a wale direction. More preferably, the first direction D1 forms an angle of less than 10° with a wale direction. However, the first direction D1 and the second direction D2 do not have to be substantially parallel to a wale direction.

In the exemplary knitted component 11, the first layer L1 and the second layer L2 are connected by knitting. Connecting the first layer L1 and the second layer L2 by knitting is advantageous because there is no need for an additional process step in which the two layers are connected, for example by means of an adhesive or by welding. Therefore, the production process is simplified and the risk of losing the differential between the process steps of knitting the first and the second layer L2 and connecting the first and the second layer L2 is prevented. Moreover, if the first layer L1 and the second layer L2 were connected by means of an adhesive, the breathability of the knitted component 11 would be deteriorated and therefore it is preferable to connect the first layer L1 and the second layer L2 by knitting. However, the first layer L1 and the second layer L2 may be connected by any other suitable means such as for example using as an adhesive or by welding.

In the exemplary knitted component 11, the first layer L1 and the second layer L2 are connected by means of at least one tuck stitch. A tuck stitch is a basic knitting operation that can be easily and quickly executed on any knitting machine. Furthermore, a tuck stitch provides for a stable connection between the first layer L1 and the second layer L2. However, the first layer L1 and the second layer L2 may be connected by means of any other suitable stitch.

In the exemplary knitted component 11, the first portion P1 on the first layer L1 is arranged in proximity to the third portion P3 on the second layer L2 and/or the second portion P2 on the first layer L1 is arranged in proximity of the fourth portion P4 on the second layer L2. By this arrangement, there is a synergetic effect by which the overall differential in the loop density in the knitted component 11 is enhanced due to the combination of the differentials in the first layer L1 and the second layer L2. If the first portion P1 on the first layer L1 is arranged in proximity to the third portion P3 on the second layer L2 this means in the present context, that at least one loop in the first portion overlaps with at least one loop in the third portion when viewed along a direction perpendicular to the first and/or second layer L2. The same applies generally, mutatis mutandis, for the expression "in proximity" herein.

In the exemplary knitted component 11, the second linear loop density is at least 20% larger than the first linear loop density and/or the fourth linear loop density may be at least 20% larger than the third linear loop density. The inventors have found that in order to create a meaningful variation in the stiffness, elasticity, and strength of the knitted component 11 it is preferable for the second linear loop density to be at least 20% larger than the first linear loop density and/or for the fourth linear loop density to be at least 20% larger than the third linear loop density. The inventors have also found that it is more preferable for the second linear loop density to be at least 40% larger than the first linear loop density and/or for the fourth linear loop density to be at least 40% larger than the third linear loop density. For example, in the first layer L1, there are approximately 4 loops per cm in portion P2 and 2.5 loops per cm in portion P1. Therefore, the second linear loop density in the second portion P2 is approximately 60% higher than the first linear loop density in the first portion P1.

In the exemplary knitted component 11, the knitting pattern in the first portion P1 is the same as the knitting pattern in the second portion P2 and the knitting pattern in the third portion P3 is the same as the knitting pattern in the fourth portion P4. By using the same knitting pattern in the first portion P1 as in the second portion P2 and by using the same knitting pattern in the third portion P3 as in the fourth portion P4 it is possible to reduce the knitting time because the complexity of the knitting process is reduced. It should be emphasized that an advantage of the knitted component 11 according to the present invention is that the knitted component 11 according to the present invention does not require more than one knitting pattern in order for the properties of the knitted component 11 to be engineered to differ across the knitted component 11. In this example, a single knitting pattern is used for the first layer L1 and a different single pattern is used for the second layer L2.

However, it is possible to use any number of knitting patterns for the first or second layer.

In the exemplary knitted component 11, the type of yarn used in the first portion P1 is the same as the type of yarn used in the second portion P2 and the type of yarn used in the third portion P3 is the same as the type of yarn used in the fourth portion P4. An advantage of the present invention is that a knitted component 11 according to the present invention does not require different types of yarn to locally engineer the mechanical properties of the knitted component 11. In this example, the first portion P1 and the second portion P2 comprise the same type of yarn and a single type of yarn is used for the first layer L1 and a different single type of yarn is used for the second layer L2. A type of yarn is, in the present context, determined by the material (for example cotton, polyester, elastane, and so on), the composition (single filament, multifilament, number of plies etc.), and the weight per unit length measured in denier or dtex, etc. The third portion P3 and the fourth portion P4 of the second layer L2 also comprise the same type of yarn. In this example, the first portion P1 and the second portion P2 comprise the same type of yarn and a single type of yarn is used for the first layer L1 and a different single type of yarn is used for the second layer L2. Thus, an article of apparel or footwear manufactured from a knitted component 11 according to the invention may be from manufactured from a single material. This improves the recyclability of the apparel or footwear and is therefore more sustainable than a conventional knitted component 11. Furthermore, the cost of production and the production time is reduced if a single type of yarn, or a reduced number of types of yarn is used. Moreover, further processing of a knitted component 11 according to the invention is improved as the material may be the same throughout the knitted component 11. However, it is also possible to use different types of yarn within any one of the portions or different types of yarn that differ between different portions. However, any number of different types of yarn may be used, wherein the maximum number is determined by the number of available yarn carriers.

In the exemplary knitted component 11, the yarn used for at least one portion of the knitted component 11 comprises polyester. The inventors have found that the stability of the differential in the loop density is greatly improved by using polyester yarn. Polyester yarn tends to be relatively stiff and therefore even very large differentials in the loop density can be maintained securely and permanently. However, many other types of yarn are suitable.

In the exemplary knitted component 11, a surface of the knitted component 11 is substantially free of any coating. A coating, for example a polymer coating, could be used to create a variation in properties, such as stiffness, elasticity, and strength across the knitted component 11. However, applying a coating requires an additional process step and therefore makes the production more complicated and expensive. Furthermore, coating the knitted component 11 deteriorates its breathability. A knitted component 11 according to the present invention does not require any coating and therefore, for the reasons outlined, it is preferably not coated. By substantially free of any coating means in the present context that preferably less than 30% of the surface of the knitted component 11 have a coating applied. More preferably, less than 15% of the surface of the knitted component 11 have a coating applied. In the present example, no coating has been applied to the first layer L1 or the second layer L2. However, in other embodiments a coating may be applied.

In the exemplary knitted component 11, the yarn used for at least one portion of the knitted component 11 comprises a melted meltable component. An alternative or additional way of stabilizing the differential in loop density is to incorporate a meltable component into the knitted component 11. A melt yarn, also known as fuse yarn, may be incorporated easily during the knitting process. For example, a thread comprising two plies of polyamide yarn with a melting temperature of 85° C. and 840 dtex is a suitable melt yarn. However, the knitted component does not have to comprise a melted meltable component.

The exemplary knitted component 11 is weft knitted. Weft knitting produces generally more elastic fabric than warp knitting and thus the range of elasticity that can be created in a knitted component according to the present invention is greater with weft knitting than with warp knitting. Furthermore, weft knitting allows for a simpler production of a knitted component 11 according to the present invention. In weft knitting, the cam system can be suitably modified using methods that are known in the prior art in order to allow the stitch length, or stitch height, to be varied even across a single course or between one course and another course. However, the knitted component may also be warp knitted.

The exemplary knitted component 11 was knitted on a flat knitting machine using two needle beds. A flat knitting machine comprising at least two needle beds allows for a particularly simple and efficient production of a knitted component 11 according to the present invention. The first needle bed knits the first layer L1 while the second needle beds knits the second layer L2 simultaneously. It is therefore possible to produce a knitted component 11 according to the present invention within a single process step. A big advantage of using a flat knitting machine is that the first portion and the second portion with their different mechanical properties may be located on the same row, or course, or the same wale. This allows specific areas with desired mechanical properties to be engineered into the knitted component.

However, the knitted component may be produced using other types of knitting machines, for example a circular knitting machine with a double cylinder.

In particular, the knitted component 11 was knitted on a flat knitting machine using gauge 18, wherein the gauge of the machine indicates the number of needles per inch and setting a needle sinker position (NSP) of 14 for the needles used to obtain the first portion P1 and an NSP of 10 on the needles used to obtain the second portion P2.

The difference between the NSP value used to knit the first portion P1 and the second portion P2 is preferably equal to or smaller than 5. It has in fact been noted that a difference in the needle sinker position larger than 5 renders the knitting process more difficult.

FIGS. 2A and 2B illustrate exemplary stitch heights SH1, SH2, SH3, and SH4 and the corresponding sizes of the knitting loops Lo1, Lo2, Lo3, Lo4, respectively.

FIG. 2A shows that the exemplary stitch height SH2 of loop Lo2 is smaller than the stitch height SH1 of loop Lo1. Therefore, by knitting a number of loops Lo2 in the second portion P2 and a number of loops Lo1 in the first portion P1, the resulting linear loop density is higher in the second portion P2 than in the first portion P1. The direction D1 along which the linear loop density is to be measured is also indicated.

FIG. 2B shows that the exemplary stitch height SH4 of loop Lo4 is smaller than the stitch height SH3 of loop Lo3. Therefore, by knitting a number of loops Lo4 in the fourth portion P4 and a number of loops Lo3 in the third portion P3, the resulting linear loop density is higher in the fourth portion P4 than in the third portion P3. The direction D2 along which the linear loop density is to be measured is also indicated.

FIG. 2C illustrates the relationship between the stitch height SH1 and the stitch length. The stitch length is the length of yarn which includes one needle loop and half the length of yarn, i.e. half a sinker loop, between that needle loop and the adjacent needle loops on either side of it. In the present example, the stitch length is the length of the loop Lo1 between points A1 and A2.

FIGS. 3A and 3B show two exemplary arrangements of knitting loops with different stitch heights within a single knitting yarn.

FIG. 3A shows an exemplary arrangement in which loops are formed by a step-like change in stitch height. Two types of loops are knitted along a course direction CD1. Loops Lo1 with stitch height SH1 (see FIG. 2A) and loops Lo2 with stitch height SH2 (see FIG. 2A), wherein the stitch height SH1 is larger than the stitch height SH2. The change between the first region P1 which comprises the loops Lo1 knitted with stitch height SH1 and the second region P2 which comprises the loops Lo2 knitted with stitch height SH2 is abrupt and step-like. However, even if the loops are knitted with a step-like change in stitch height, it is possible that due to the elasticity of the knitted component, the final knitted component has a gradual change in loop density between the first region P1 and the second region P2. The loop density is to be measured along direction D1 as indicated.

The same may apply, mutatis mutandis, to the third portion P3 and the fourth portion P4.

FIG. 3B shows an exemplary arrangement in which loops are formed with a gradual change in stitch height. Four types of loops are knitted along a course direction CD1. Loops Lo1, Lo2, Lo3, Lo4 with gradually decreasing stitch heights SH1, SH2, SH3, SH4, respectively. Therefore, the final knitted component has a gradual change in loop density between the first region P1 and the second region P2. The loop density is to be measured along direction D1 as indicated. Since the change in loop density is gradual, half of the area over which the loop density varies gradually should be considered as being part of the first portion P1 and the other half of that area should be considered as being part of the second portion P2 for the purpose of calculating the area of the first portion and of the second portion. Correspondingly, half of the number of loops in the region of gradual variation should be considered as being part of the first portion P1 and the other half of those loops should be considered as being part of the second portion P2 for the purpose of calculating the number of loops of the first portion P1 and of the second portion P2. This is illustrated in FIG. 3B.

The same may apply, mutatis mutandis, to the third portion P3 and the fourth portion P4.

FIG. 4 shows an exemplary knitting pattern, sometimes this pattern is referred to as stockinette, as known in the prior art. Three rows, or courses, of yarn are shown as they extend generally along a course direction CD1. Interlocking loops of constant stitch height are formed by any suitable technique known in the prior art, for example by weft knitting on a flat-bed knitting machine.

Figure 5B:
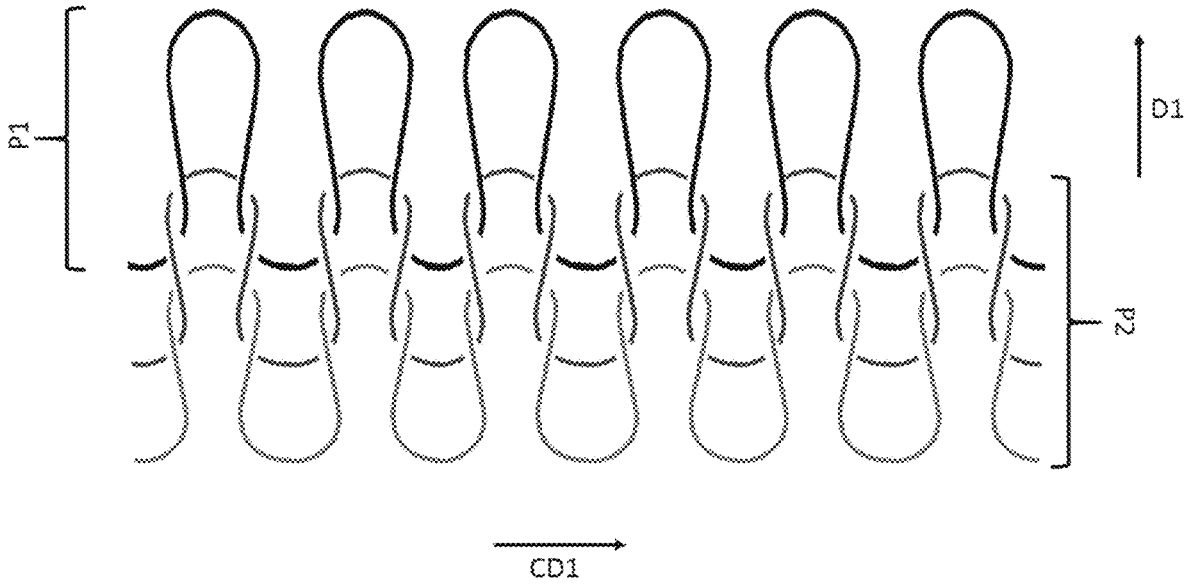

FIGS. 5A and 5B show part of two exemplary modifications of the stockinette pattern shown in FIG. 4 according to the present invention. While the examples in FIG. 5A and FIG. 5B both show a step-like change in stitch height, similar patterns could be knitted with a gradual change in stitch height as illustrated in FIG. 3B.

FIG. 5A shows a stockinette-like pattern according to the present invention. Note that only the first layer L1 is shown and that the connection between the first L1 and the second layer L2 is not shown for clarity. Knitting yarns are knitted along a course direction CD1 and interlocked with each other. Two portions are formed, in the first portion P1 the stitch height is larger than in the second portion P2. The resulting loop density measured along direction D1 is therefore larger in the second portion P2 than in the first portion P1. Note that the two portions are separated along a course direction and each of the three yarns passes through the first portion P1. That is, the first portion P1 and the second portion P2 comprise at least one shared yarn. As the differential in loop density is engineered to occur along a single yarn this enables more ways of creating a differential across the knitted component than would be possible if such a differential could not be created along a single yarn. Therefore, the functionality and wearing comfort of a resulting article of apparel or footwear is improved.

The same may apply, mutatis mutandis, to the third portion P3 and the fourth portion P4 on the second layer.

FIG. 5B shows another stockinette-like pattern according to the present invention. Note that only the first layer L1 is shown and that the connection between the first L1 and the second layer L2 is not shown for clarity. Knitting yarns are knitted along a course direction CD1 and interlocked with each other. In the example of FIG. 5B, the bottom two courses are knitted with a second stitch height SH2 and the topmost course is knitted with a first stitch height SH1 which is larger than SH2. The resulting loop density measured along direction D1 is therefore larger in the second portion P2 than in the first portion P1.

The same may apply, mutatis mutandis, to the third portion P3 and the fourth portion P4 on the second layer.

Figure 6B:
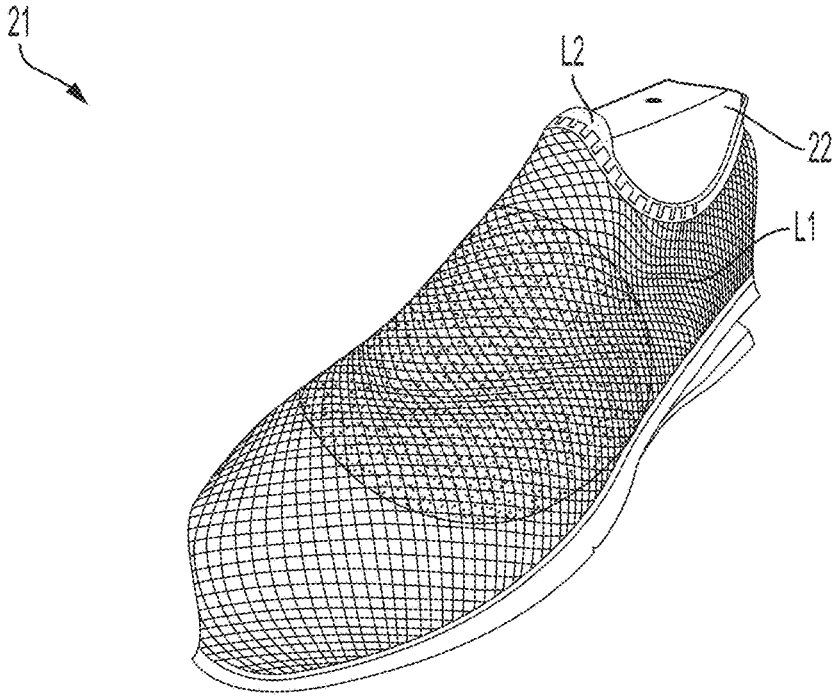

FIGS. 6A and 6B show an exemplary shoe 21 on a last 22 according to the present invention. The shoe 21 comprises a knitted component according to the present invention.

Some embodiments relate to a knitted component, especially for an article of apparel or footwear that includes a first knitted layer that includes a knitted first portion with a first linear loop density along a first direction, a knitted second portion with a second linear loop density along the first direction, wherein the second linear loop density is greater than the first linear loop density; and a second knitted layer that includes a knitted third portion with a third linear loop density along a second direction, a knitted fourth portion with a fourth linear loop density along the second direction, and wherein the first knitted layer is connected to the second knitted layer.

In some embodiments, the first direction and/or the second direction may be substantially parallel to a wale direction.

In some embodiments, the knitted first layer and the knitted second layer may be connected by means of at least one tuck stitch.

In some embodiments, the knitted first portion on the first knitted layer may be arranged in proximity of the knitted third portion on the second knitted layer; and/or the knitted second portion on the first knitted layer may be arranged in proximity of the knitted fourth portion on the second knitted layer.

In some embodiments, a yarn used for at least one of the knitted first portion, the knitted second portion, the knitted third portion, and the knitted fourth portion of the knitted component may include polyester.

In some embodiments, a surface of the knitted component may be substantially free of any coating.

In some embodiments, the knitted component may be weft knitted.

In some embodiments, the knitted component may be knitted on a flat knitting machine using at least two needle beds.

Some embodiments described herein relate to an article of apparel that includes a knitted component as described herein.

Some embodiments relate to an upper for an article of footwear that may include a knitted component as described herein, and the upper may further include a sole.

Some embodiments relate to a method for producing a knitted component, especially for an article of apparel or footwear, including: knitting a first knitted layer, including: knitting a first portion with a first stitch height along a first direction, knitting a second portion with a second stitch height along the first direction, wherein the second stitch height is smaller than the first stitch height; knitting a second knitted layer, including: knitting a third portion with a third stitch height along a second direction, knitting a fourth portion with a fourth stitch height along the second direction; and connecting the first knitted layer to the second knitted layer.

In some embodiments, connecting the first knitted layer to the second knitted layer may be done over substantially an entire surface that forms an interface between the first knitted layer and the second knitted layer.

In some embodiments, the first direction and/or the second direction may be substantially parallel to a wale direction.

In some embodiments, connecting the first knitted layer and the second knitted layer may include knitting at least one tuck stitch.

In some embodiments, a method for producing a knitted component may further include arranging the first portion on the first knitted layer in proximity of the third portion on the second knitted layer; and/or arranging the second portion on the first knitted layer in proximity of the fourth portion on the second knitted layer.

In some embodiments, the first stitch height may be at least 20% larger than the second stitch height; and/or the third stitch height may be at least 20% larger than the fourth stitch height.

In some embodiments, a yarn used for at least one of the first portion, the second portion, the third portion, and the fourth portion of the knitted component may include polyester.

In some embodiments, a surface of the knitted component may be substantially free of any coating.

In some embodiments, a yarn used for at least one of the first portion, the second portion, the third portion, and the fourth portion of the knitted component may include a melted meltable component.

In some embodiments, the knitted component may be knitted on a flat knitting machine using at least two needle beds.

Some embodiments described herein relate to a method for producing an article of apparel including producing a knitted component made by a method as described herein.

Some embodiments described herein relate to a method for producing an upper for an article of footwear may include providing a knitted component made by a method as described herein and lasting the knitted component.

Some embodiments herein relate to a method for producing an article of footwear including providing an upper as described herein and attaching a sole to the upper.

What is claimed is:

1. A knitted component, especially for an article of apparel or footwear, comprising:

a first knitted layer, comprising a knitted first portion comprising a first plurality of knitted loops with a same first stitch height along a first direction such that the knitted first portion has a first linear loop density along the first direction, a knitted second portion comprising a second plurality of knitted loops with a same second stitch height along the first direction such that the knitted second portion has a second linear loop density along the first direction, wherein the second stitch height is less than the first stitch height; and a second knitted layer, comprising a knitted third portion comprising a third plurality of knitted loops with a same third stitch height along a second direction such that the knitted third portion has a third linear loop density along the second direction, a knitted fourth portion comprising a fourth plurality of knitted loops with a same fourth stitch height along the second direction such that the knitted fourth portion has a fourth linear loop density along the second direction;

wherein the first knitted layer and the second knitted layer are connected by knitting and are of a unitary knit construction, and wherein the knitted component is weft knitted.

2. The knitted component according to claim 1, wherein the first knitted layer is connected to the second knitted layer over substantially an entire surface that forms an interface between the first knitted layer and the second knitted layer.

3. The knitted component according to claim 1, wherein the fourth linear loop density is greater than the third linear loop density.

4. The knitted component according to claim 1, wherein the first direction is substantially parallel to the second direction.

5. The knitted component according to claim 1, wherein the knitted first portion and the knitted second portion comprise at least one shared yarn; and/or wherein the knitted third portion and the knitted fourth portion comprise at least one shared yarn.

6. The knitted component according to claim 1, wherein the second linear loop density is at least 20% larger than the first linear loop density; and/or wherein the fourth linear loop density is at least 20% larger than the third linear loop density.

7. The knitted component according to claim 1, wherein a knitting pattern in the knitted first portion is the same as a knitting pattern in the knitted second portion; and/or wherein a knitting pattern in the knitted third portion is the same as a knitting pattern in the knitted fourth portion.

8. The knitted component according to claim 1, wherein a type of yarn used in the knitted first portion is the same as a type of yarn used in the knitted second portion; and/or wherein a type of yarn used in the knitted third portion is the same as a type of yarn used in the knitted fourth portion.

9. The knitted component according to claim 1, wherein a yarn used for at least one of the knitted first portion, the knitted second portion, the knitted third portion, and the knitted fourth portion of the knitted component comprises a melted meltable component.

10. The knitted component of claim 1, wherein the knitted component comprises a shoe upper comprising a toe region and an instep region, and wherein the knitted second portion is arranged in the toe region and wherein the knitted first portion is arranged in the instep region, such that the toe region has a higher stiffness than the instep region.

11. An upper for an article of footwear comprising a knitted component according to claim 1.

12. A knitted component, comprising:

a first knitted layer comprising:

a knitted first portion with a first plurality of knitted loops having a same first stitch height along a wale direction such that the knitted first portion has a first linear loop density along the first direction, a knitted second portion with a second plurality of knitted loops having a same second stitch height along the wale direction such that the knitted second portion has a second linear loop density along the first direction, wherein the second linear loop density is greater than the first linear loop density, wherein the first knitted layer is weft knitted; and a second knitted layer, comprising:

a knitted third portion with a third plurality of knitted loops having a same third stitch height along a second direction such that the knitted first portion has a third linear loop density along the second direction, a knitted fourth portion with a fourth plurality of knitted loops having a same fourth stitch height along the second direction such that the knitted fourth portion has a fourth linear loop density along the second direction, wherein the fourth linear loop density is greater than the third linear loop density;

wherein the knitted first portion is arranged such that at least one loop of the first portion overlaps with at least one loop of the third portion; and wherein a surface of the first knitted layer is connected to a surface of the second knitted layer.

13. The knitted component according to claim 12, wherein the first knitted layer is connected to the second knitted layer over substantially an entire surface that forms an interface between the first knitted layer and the second knitted layer.

14. The knitted component according to claim 12, wherein the knitted first portion and the knitted second portion comprise at least one shared yarn.

15. The knitted component according to claim 12, wherein the second linear loop density is at least 20% larger than the first linear loop density.

16. The knitted component according to claim 12, wherein a knitting pattern in the knitted first portion is the same as a knitting pattern in the knitted second portion.

17. The knitted component according to claim 12, wherein a type of yam used in the knitted first portion is the same as a type of yam used in the knitted second portion.

18. The knitted component according to claim 12, wherein a yam used for at least one of the knitted first portion and the knitted second portion comprises a melted or meltable component.

* * * * *